US008784580B2

(12) United States Patent
Fugono et al.

(10) Patent No.: US 8,784,580 B2
(45) **Date of Patent: *Jul. 22, 2014**

(54) COPPER ALLOY SHEET EXCELLENT IN STRENGTH AND FORMABILITY FOR ELECTRICAL AND ELECTRONIC COMPONENTS

(75) Inventors: Akira Fugono, Shimonoseki (JP); Hiroshi Sakamoto, Shimonoseki (JP)
(73) Assignee: Kobe Steel, Ltd., Kobe-shi (JP)

( * ) Notice: Subject to any disclaimer, the term of this patent is extended or adjusted under 35 U.S.C. 154(b) by 285 days.

This patent is subject to a terminal disclaimer.

(21) Appl. No.: 12/523,070

(22) PCT Filed: Feb. 14, 2008

(86) PCT No.: PCT/JP2008/052455
§ 371 (c)(1), (2), (4) Date: Jul. 14, 2009

(87) PCT Pub. No.: WO2008/099892
PCT Pub. Date: Aug. 21, 2008

(65) Prior Publication Data
US 2010/0047112 A1 Feb. 25, 2010

(30) Foreign Application Priority Data
Feb. 16, 2007 (JP) ..... 2007-035726

(51) Int. Cl.
*C22C 9/06* (2006.01)
*C22C 9/10* (2006.01)
*C22C 9/02* (2006.01)
*C22C 9/04* (2006.01)
*C22F 1/08* (2006.01)

(52) U.S. Cl.
USPC ..... 148/435; 148/553; 148/554; 148/682; 420/485; 420/486; 420/487; 420/488

(58) Field of Classification Search
USPC ..... 148/435, 553, 554, 682; 420/485, 486, 420/487, 488
See application file for complete search history.

(56) References Cited

U.S. PATENT DOCUMENTS 6,334,915 B1 * 1/2002 Ogura et al. ..... 148/435
2004/0079456 A1 4/2004 Mandigo et al.

(Continued)

FOREIGN PATENT DOCUMENTS

| | | | |
|---|---|---|---|
| EP | 03-162553 | | 7/1991 |
| EP | 03-188247 | | 8/1991 |
| EP | 0 949 343 | | 10/1999 |
| EP | 2006-016629 | | 1/2006 |
| JP | 3 162553 | | 7/1991 |
| JP | 3 188247 | | 8/1991 |
| JP | 5 59505 | | 3/1993 |
| JP | 5 179377 | | 7/1993 |
| JP | 10 110228 | | 4/1998 |
| JP | 10110228 | * | 4/1998 |
| JP | 2000 80428 | | 3/2000 |
| JP | 2002 266042 | | 9/2002 |
| JP | 2006 219733 | | 8/2006 |

OTHER PUBLICATIONS

European Supplementary European Search Report in European Application No. 08711294.2 dated Jun. 1, 2011.

*Primary Examiner* — Sikyin Ip
(74) *Attorney, Agent, or Firm* — Oblon, Spivak, McClelland, Maier & Neustadt, L.L.P.

(57) ABSTRACT

Disclosed is a Cu—Ni—Si copper alloy sheet that excels in strength and formability and is used in electrical and electronic components. The copper alloy sheet contains, by mass, 1.5% to 4.5% Ni and 0.3% to 1.0% of Si and optionally contains at least one member selected from 0.01% to 1.3% of Sn, 0.005% to 0.2% of Mg, 0.01% to 5% of Zn, 0.01% to 0.5% of Mn, and 0.001% to 0.3% of Cr, with the remainder being copper and inevitable impurities. The average size of crystal grains is 10 μm or less, the standard deviation σ of crystal grain size satisfies the condition: $2\sigma<10$ μm, and the number of dispersed precipitates lying on grain boundaries and having a grain size of from 30 to 300 nm is 500 or more per millimeter.

20 Claims, 1 Drawing Sheet

(56) References Cited

U.S. PATENT DOCUMENTS

2008/0047634 A1* 2/2008 Mihara et al. ..... 148/414
2008/0090096 A1 4/2008 Suzuki et al.
2009/0053553 A1 2/2009 Masago et al.
2009/0101243 A1 4/2009 Aruga et al.
2009/0116996 A1 5/2009 Aruga et al.

* cited by examiner

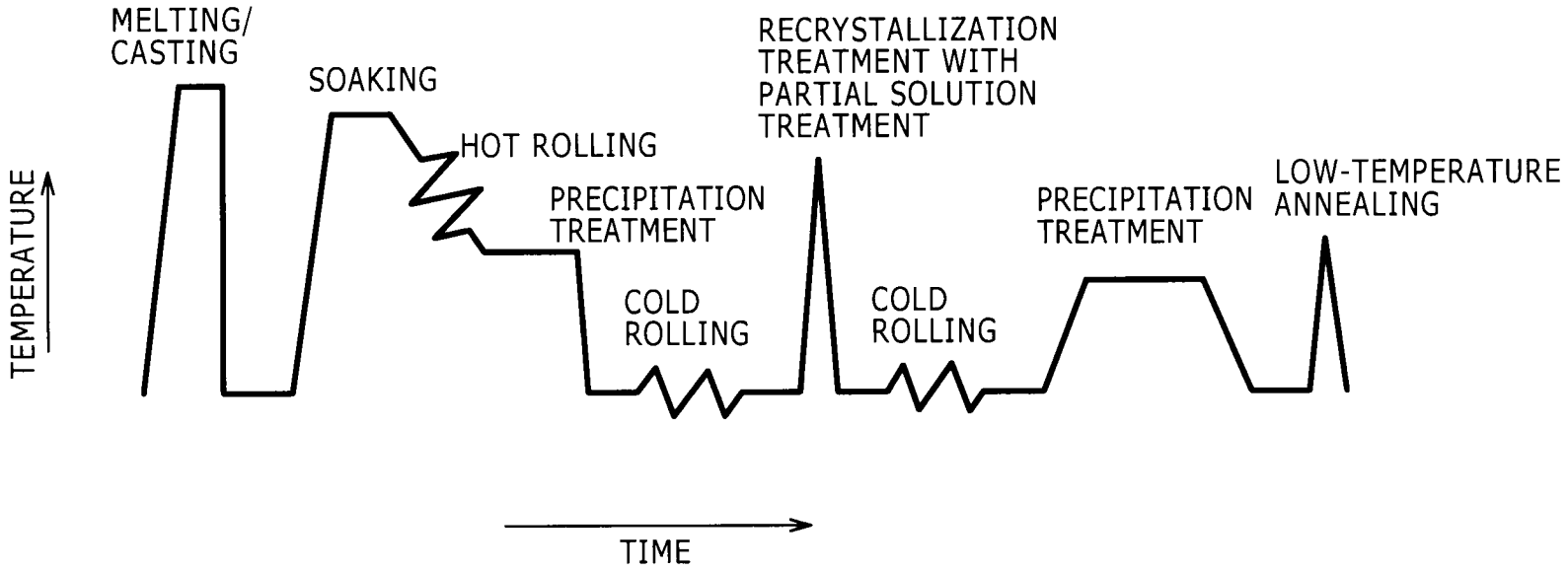
MELTING/
CASTING
SOAKING
HOT ROLLING
PRECIPITATION
TREATMENT
COLD
ROLLING
RECRYSTALLIZATION
TREATMENT WITH
PARTIAL SOLUTION
TREATMENT
COLD
ROLLING
PRECIPITATION
TREATMENT
LOW-TEMPERATURE
ANNEALING
TIME
TEMPERATURE

COPPER ALLOY SHEET EXCELLENT IN STRENGTH AND FORMABILITY FOR ELECTRICAL AND ELECTRONIC COMPONENTS

TECHNICAL FIELD

The present invention relates to copper alloy sheets for use in electrical and electronic components. They are used typically in electrical and electronic components such as terminals/connectors and relays; materials for semiconductor devices, such as lead frames and radiator plates (heat sinks); materials for electrical circuits, such as automotive junction blocks (JB) and circuits for household electrical components.

BACKGROUND ART

Automobiles have been equipped with more and more electrical and electronic components for the compliance with environmental regulations and for the pursuit of comfort and safety, and this requires further narrower pitches and further smaller sizes typically of terminals/connectors and relaying components to be used in the automobiles. Similar requirements have been also made in information communications and household products. For these uses, Cu—Ni—Si alloys have been widely used, because the alloys simultaneously have high strength, high thermal stability, high stress relaxation resistance, and relatively high electric conductivity.

With the down-sizing of electrical and electronic components, more demands have been made on copper alloy sheets for use in electrical and electronic components to have not only high strength and high electric conductivity but also excellent bending workability so as to endure 180-degree bending or 90-degree bending after notching. Additionally, with the down-sizing of electrical and electronic components, severe bending is often conducted in a bend line in parallel to the rolling direction, so-called "bad way" (B.W.), whereas conventional severe bending has been conducted in a bend line transverse to the rolling direction, so-called "good way" (G.W.).

Patent Documents 1 to 5 mentioned below disclose techniques for improving the bending workability of Cu—Ni—Si alloys both in G.W. and B.W.

Specifically, to improve the bending workability, the techniques disclosed in Patent Documents 1 and2 specify the compositions of Cu—Ni—Si alloys and conditions for working and heat treatment; the technique disclosed in Patent Document 3 controls the degree of accumulation of crystal orientation in the sheet surface; the technique discloses in Patent Document 4 specifies the ratio of yield stress to tensile strength, the ratio of uniform elongation to total elongation, and the work hardening coefficient; and the technique discloses in Patent Document 5 controls the electric conductivity and the yield stress in directions in parallel to and transverse to the rolling direction after solution annealing and specifies the processing rate (reduction ratio) in finish cold rolling after solution annealing.

Patent Document 1: Japanese Unexamined Patent Application Publication (JP-A) No. 59505/1993

Patent Document 2: JP-A No. 179377/1993

Patent Document 3: JP-A No. 80428/2000

Patent Document 4: JP-A No. 266042/2002

Patent Document 5: JP-A No. 219733/2006

DISCLOSURE OF INVENTION

Problems to be Solved by the Invention

However, it has been difficult to allow current Cu—Ni—Si alloys to have both high strength and excellent bending workability.

Accordingly, an object of the present invention is to provide a Cu—Ni—Si copper alloy sheet for use in electrical and electronic components, which has both high strength and excellent bending workability.

Means for Solving the Problems

After intensive investigations on the bending workability of Cu—Ni—Si alloy sheets, the present inventors have found that the average size of crystal grains and the standard deviation ($\sigma$) of grain size showing the dispersion thereof significantly affect the bending workability of Cu—Ni—Si alloy sheets. The present invention has been made based on these findings.

Specifically, the present invention provides a copper alloy sheet excellent in strength and formability for use in electrical and electronic components, containing 1.5% to 4.5% (percent by mass, hereinafter the same) of nickel (Ni) and 0.3%, to 1.0% of silicon (Si), with the remainder being copper and inevitable impurities, in which the copper alloy sheet has an average size of crystal grains of 10 μm or less and a standard deviation $\sigma$ of crystal grain size satisfying the condition: $2\sigma<10$ μm.

To obtain the average size of crystal grains and the standard deviation specified above, the number of dispersed precipitates of from 30 to 300 nm lying on grain boundaries should be 500 or more per millimeter.

The Cu—Ni—Si alloy may further contain, in addition to Ni and Si, one or more members selected from the group consisting of 0.01% to 1.3% of tin (Sn), 0.005% to 0.2% of magnesium (Mg), 0.01% to 5% of zinc (Zn), 0.01% to 0.5% of manganese (Mn), 0.001% to 0.3% of chromium (Cr), according to necessity. The alloy may also further contain a total of 0.1% or less of at least one member selected from the first group of elements consisting of, each 0.0001% to 0.1% of, B, C, P, S, Ca, V, Ga, Ge, Nb, Mo, Hf, Ta, Bi, and Pb; and a total of 1% or less of at least one member selected from the second group of elements consisting of, each 0.001% to 1% of, Be, Al, Ti, Fe, Co, Zr, Ag, Cd, In, Sb, Te, and Au, in which the total content of the first and second groups of elements is 1% or less.

Advantages

The present invention can provide a copper alloy sheet for use in electrical and electronic components, which contains a Cu—Ni—Si copper alloy and has high strength and excellent bending workability both in directions in parallel to and transverse to the rolling direction.

BRIEF DESCRIPTION OF DRAWING

FIG. 1 The sole figure schematically illustrates a process for producing a copper alloy sheet according to the present invention.

BEST MODES FOR CARRYING OUT THE INVENTION

The copper alloy sheet for electrical and electronic components, according to the present invention, will be illustrated in detail below. Initially, the composition of a copper alloy for use in the present invention will be illustrated.

Nickel (Ni) and silicon (Si) elements form $Ni_2$ Si precipitates and improve the strength of the alloy. However, if Ni is contained in a content of less than 1.5% or/and Si is contained in a content of less than 0.3%, these elements may not sufficiently improve the strength. In contrast, if Ni is contained in a content of more than 4.5% or/and Si is contained in a content of more than 1%, Ni or Si crystallizes or precipitates during casting to thereby impair the hot workability. Accordingly, the Ni content should be from 1.5% to 4.5% and the Si content should be from 0.3% to 1.0%. The Ni content is preferably from 1.7% to 3.9%, and more preferably from 1.7% to 3.3%; and the Si content is preferably from 0.35% to 0.90%, and more preferably from 0.35% to 0.75%. The ratio of the Ni content to the Si content (Ni/Si ratio) is preferably from 4.0 to 5.0, and especially preferably around 4.5. If the Ni/Si ratio largely deviates from the above-specified ratio, excessive Ni or Si may dissolve in the Cu matrix to form a solid solution to thereby reduce the electric conductivity.

The copper alloy for use in the present invention may further contain Sn, Mg, Zn, Mn, Cr, and other elements as accessory components.

Tin (Sn) dissolves in the Cu matrix as a solid solution to improve the strength. For exhibiting the effect, tin should be added in a content of 0.01% or more. In contrast, tin, if contained in a content of more than 1.3%, may reduce the electric conductivity and impair the hot workability. Accordingly, the Sn content, if added, should be 0.01% to 1.3%. It is preferably 0.01% to 0.6%, and more preferably 0.01% to 0.3%.

Magnesium (Mg) dissolves in the Cu matrix as a solid solution to improve the strength. For exhibiting the effect, magnesium should be added in a content of 0.005% or more. In contrast, magnesium, if contained in a content of more than 0.2%, may impair the bending workability and electric conductivity. Accordingly, the Mg content, if added, should be 0.005% to 0.2%. It is preferably 0.005% to 0.15%, and more preferably 0.005% to 0.05%.

Zinc (Zn) improves the tin-plating peeling resistance of the copper alloy sheet. For exhibiting this effect, zinc should be added in a content of 0.01% or more. In contrast, zinc, if contained in a content of more than 5%, may impair the bending workability and electric conductivity. Accordingly, the Zn content, if added, should be 0.01% to 5%. It is preferably 0.01% to 2%, and more preferably 0.01% to 1.2%.

Manganese (Mn) and chromium (Cr) improve the hot workability. For satisfactorily exhibiting the effect, the Mn content should be 0.01% or more, and the Cr content should be 0.001% or more. In contrast, manganese, if contained in a content of more than 0.5%, may reduce the electric conductivity, and chromium, if contained in a content of more than 0.3%, may cause generation of crystals to thereby reduce the properties such as formability. Accordingly, the Mn content should be from 0.01% to 0.5%, and the Cr content should be from 0.001% to 0.3%, if added. The Mn and Cr contents are preferably from 0.01% to 0.3% and from 0.001% to 0.1%, respectively.

The first group of elements B, C, P, S, Ca, V, Ga, Ge, Nb, Mo, Hf, Ta, Bi, and Pb act to improve the punching quality. Each of these elements, if contained in a content of less than 0.0001%, may not exhibit this effect, and, if contained in a content of more than 0.1%, may impair the hot workability. The second group of elements Be, Al, Ti, Fe, Co, Zr, Ag, Cd, In, Sb, Te, and Au act to improve the punching quality and, as a result of coexistence with the $Ni_2Si$ precipitates, act to improve the strength. Among them, Ti and Zr act to further improve the hot workability. Each of these elements, if contained in a content of less than 0.001%, may not sufficiently exhibit these activities, and, if contained in a content of more than 1%, may adversely affect the hot and cold workability. When any of these elements is added, the content of each element of the first group of elements is 0.0001% to 0.1%, and the total content of the first group of elements is 0.1% or less; the content of each element of the second group of elements is 0.001% to 1%; and the total content of the first and second groups of elements is 1% or less.

Next, the crystalline structure of the copper alloy sheet according to the present invention will be described.

The copper alloy sheet according to the present invention has an average size of crystal grains of 10 μm or less and a standard deviation σ of crystal grain size satisfying the condition: $2\sigma<10$ μm. The standard deviation σ of crystal grain size is the average of deviations of grain sizes of respective crystal grains from the average size of crystal grains. When the distribution of crystal grain size approximates to the normal distribution, about 95% of total crystal grains in the copper alloy sheet according to the present invention have a crystal grain size ranging from $(d-2\sigma)$ to $(d+2\sigma)$ (μm), in which "d" represents the average size of crystal grains. Namely, the abundance of coarse crystal grains having a size largely exceeding the average size of crystal grains is very small.

If the average size of crystal grains is more than 10 μm or if the standard deviation of crystal grain size does not satisfy the condition: $2\sigma<10$ μm, the bending workability deteriorates both in G.W. and B.W. to cause cracks in W-bending at a radius R of 0.05 mm. The average size d of crystal grains and the standard deviation σ preferably satisfy the condition: $d\leq 2\sigma$, and the average size of crystal grains is preferably 5 μm or less. Both the average size d of crystal grains and the standard deviation σ are preferably as low as possible, and their lower limits are not especially limited. In current actual operations, the lower limit of the average size of crystal grains in the copper alloy sheet having a composition as specified in the present invention is around 3.0 μm.

A copper alloy sheet having a composition as specified in the present invention may possibly be produced by a common standard process, in which the material copper alloy is sequentially subjected to melting/casting, soaking, hot rolling, quenching after hot rolling, cold rolling, recrystallization+solution treatment, cold rolling, precipitation treatment, and low-temperature annealing. In this process, quenching after hot rolling suppresses the precipitation of $Ni_2Si$, the solution treatment causes Ni and Si dissolve almost completely in the copper matrix and fine $Ni_2Si$ precipitates are produced in the subsequent precipitation treatment. According to this process, however, the recrystallization occurs simultaneously with the solution treatment, and this causes recrystallized grains to be coarse.

In contrast, the recrystallized grains should be prevented from becoming coarse in the solution treatment so as to give such average size of crystal grains and standard deviation of crystal grains as specified in the present invention in the copper alloy sheet having a composition as specified in the present invention. For this purpose, the present inventors allow the copper alloy to contain a large number of dispersed precipitates having a pinning effect of grain growth inhibition during the solution treatment. An exemplary but not-limitative process for this is a process in which the work is not quenched to room temperature immediately after hot rolling but is maintained at a predetermined temperature for a predetermined duration in the midway of cooling after hot rolling, followed by precipitation treatment; and the solution treatment is conducted under such selected conditions that the precipitates are not fully dissolved in the copper matrix (in the present description, this treatment is referred to as "recrystallization treatment with partial solution treatment" for distinguishing from the common solution treatment).

In general, dispersed precipitates lying on grain boundaries of a precipitation-strengthened copper alloy have been considered to cause cracks during bending (for example, JP-A NO. 97639/2005), and as a possible solution to this, the work is quenched immediately after hot rolling, and the solution treatment is conducted so as to give a complete solution in the common process.

The production process to be employed herein sequentially includes the steps of melting/casting, soaking, hot rolling, precipitation treatment after hot rolling, cold rolling, recrystallization treatment with partial solution treatment, cold rolling, precipitation treatment, and low-temperature annealing, as schematically illustrated in FIG. 1. Preferred conditions in the respective steps will be described below.

The soaking is carried out under conditions of holding the work at a temperature of 850° C. or higher for a duration of 10 minutes or more, followed by hot rolling. The cooling rate from the beginning temperature of hot rolling to 700° C. including the hot rolling step is 20° C./minute or more. If the cooling rate to 700° C. is lower than the above-specified range, coarse precipitates may be generated, and this may cause insufficiency of precipitates exhibiting pinning effects in the later recrystallization treatment with partial solution treatment and inhibits the precipitation of fine precipitates having hardening or strengthening effects.

The precipitation treatment after hot rolling is carried out under conditions of holding the work at temperatures of from 300° C. to 600° C. in the midway of cooling after hot rolling, for a duration of 10 minutes or more. The cooling from 700° C. to the holding temperature in the precipitation treatment may be carried out at a cooling rate of 20° C./minute or more, subsequent to the cooling from the beginning temperature of the hot rolling to 700° C., but this cooling rate is not essential. The precipitation treatment allows dispersed precipitates to precipitate, which will exhibit pinning effects in the later recrystallization treatment. If the holding temperature is lower than 300° C. or higher than 600° C., or if the holding duration is less than 10 minutes, the precipitation may be insufficient and the amount of dispersed precipitates exhibiting pining effects is insufficient.

The cold rolling after the hot rolling is conducted at a reduction ratio of 50% or more, and preferably 80% or more. The cold rolling allows nucleation sites for recrystallization to be introduced.

The recrystallization treatment with partial solution treatment is carried out under such conditions that the precipitates are not fully dissolved in the Cu matrix (not fully converted into a solution). Specifically, the condition may be selected from conditions of holding the work at temperatures of from 600° C. to 950° C., and preferably from 650° C. to 900° C., for a duration of 3 minutes or less. However, a suitable temperature of the recrystallization treatment varies depending on the Ni and Si contents in the copper alloy, and the work is preferably held at a lower temperature within the above-specified range at lower Ni and Si contents, and is preferably held at a higher temperature within the above-specified range at higher Ni and Si contents. Specifically, a temperature which is within the above-specified range and is substantial proportional to the Ni and Si contents may be selected. Specific preferred temperatures are shown in Examples mentioned later. Within the above-specified temperature range, a precipitation/solid-solution reaction in equilibrium with the holding temperature occurs to give certain amounts of precipitates, or precipitates grown during heating are not completely dissolved due to heating for a short time period, and the resulting precipitates exhibit pinning effects during the recrystallization treatment to thereby prevent recrystallized grains from becoming coarse. Though varying depending on the Ni and Si contents and on the holding temperature, a preferred holding duration becomes shorter with an elevating holding temperature. After the treatment, the work is cooled at a cooling rate of 50° C./second or more.

The cold rolling after the recrystallization treatment with partial solution treatment is carried out at a reduction ratio of 50% or less. The cold rolling, if carried out at a high reduction ratio, may impair the bending workability, and it is therefore preferably carried out at a reduction ratio of 50% or less. The cold rolling allows nucleation sites for precipitation to be introduced.

Subsequently, the precipitation treatment is carried out at a temperature of from 350° C. to 500° C. for a duration of from 30 minutes to 24 hours. These conditions are the same as in common processes. A precipitation treatment at a holding temperature lower than 350° C. may impede the precipitation of $Ni_2Si$. A precipitation treatment at a holding temperature higher than 500° C. may impair the strength of the copper alloy sheet to thereby fail to ensure necessary yield stress. A precipitation treatment for a duration of less than 30 minutes may impede the precipitation of $Ni_2Si$, and a precipitation treatment for a duration of more than 24 hours may impair the productivity.

The low-temperature annealing is carried out according to necessity by holding the work at a temperature of from 300° C. to 600° C. for a duration of from 1 second to 1 minute, for relieving strain.

In the above-mentioned production method, it is accepted to carry out cold rolling and recrystallization treatment with partial solution treatment repeatedly after the hot rolling; to carry out finish cold rolling after the precipitation treatment; and/or to omit the low-temperature annealing. The reduction ratio in cold rolling, if conducted after the precipitation treatment, is preferably such that the total reduction ratio with the reduction ratio of the cold rolling carried out prior precipitation treatment be 50% or less.

In a copper alloy sheet having an average size d of crystal grains and a standard deviation $\sigma$ of crystal grain size as specified in the present invention, dispersed precipitates lying on grain boundaries and having a grain size of from 30 to 300 nm are present in a number of 500 or more per millimeter. In general, precipitates precipitated during the precipitation treatment after quenching, which is in turn carried out after solution treatment, are fine and generally have a grain size of from several nanometers to thirty (30) nanometers, and most of which have a grain size of less than ten (10) nanometers. In contrast, crystals are coarse, most of which generally have a grain size of more than 300 nm. It is therefore speculated that all or most of dispersed precipitates having a grain size of 30 to 300 nm and lying on grain boundaries in the copper alloy sheet as a final product are precipitates ($Ni_2Si$) which have been produced in the precipitation treatment after hot rolling and which have remained without completely being dissolved during the recrystallization treatment with partial solution treatment, and that these precipitates exhibit pinning effects of grain boundaries to prevent recrystallized grains from becoming coarse during the recrystallization treatment. The amount of precipitates having a diameter of 30 to 300 nm is preferably 1000 or more per millimeter. The upper limit of the number is not especially limited, but the advantages of the dispersed precipitates may be substantially saturated at a number of 10000 per millimeter.

EXAMPLES

Each of copper alloys having compositions in Tables 1 and 2 was melted and cast, while the surface of the melt being covered by charcoal in a cryptol furnace in the atmosphere (air). The ingots were heated and soaked by holding at 950° C. for 1 hour, followed by hot rolling, the hot rolling was finished at 700° C. or higher to give works 20 mm thick. Samples Nos. 1 to 30 were held at 500° C. for 120 minutes in the midway of cooling and then cooled with water to room temperature. The cooling rate of cooling from the beginning temperature of hot rolling to 500° C. was 50° C./minute. Samples Nos. 31 to 33 were cooled from the beginning temperature of hot rolling to 700° C. at a cooling rate of 50° C./minute and then cooled with water from 700° C.

TABLE 1

| | Chemical composition | | | | | | | Cooling rate | Holding duration | Recrystallization treatment | | Average size d of crystal |
|---|---|---|---|---|---|---|---|---|---|---|---|---|
| No. | Ni | Si | Sn | Zn | Mn | Mg | Cr | (° C./min) | (min) | Temperature (° C.) | Duration (sec) | grains (μm) |
| 1 | 1.8 | 0.40 | 0.1 | 1.10 | 0.015 | 0.020 | — | 50 | 120 | 720 | 60 | 3.3 |
| 2 | 3.2 | 0.70 | 0.2 | 1.00 | 0.02 | — | — | 50 | 120 | 800 | 60 | 3.4 |
| 3 | 3.2 | 0.70 | 0.1 | 1.00 | 0.02 | — | — | 50 | 120 | 820 | 60 | 9.0 |
| 4 | 3.2 | 0.70 | 0.1 | 1.00 | 0.02 | — | — | 50 | 120 | 840 | 60 | 9.0 |
| 5 | 3.6 | 0.80 | 0.1 | 0.80 | 0.06 | — | — | 50 | 120 | 850 | 60 | 3.2 |
| 6 | 4.2 | 0.93 | 0.1 | 0.80 | 0.045 | — | — | 50 | 120 | 880 | 60 | 3.5 |
| 7 | 3.2 | 0.70 | — | 0.30 | 0.02 | — | — | 50 | 120 | 800 | 60 | 3.1 |
| 8 | 3.2 | 0.70 | — | — | — | — | — | 50 | 120 | 800 | 60 | 3.8 |
| 9 | 3.2 | 0.70 | 0.02 | — | — | — | — | 50 | 120 | 800 | 60 | 3.7 |
| 10 | 3.2 | 0.70 | — | — | — | 0.006 | — | 50 | 120 | 800 | 60 | 3.6 |
| 11 | 3.2 | 0.70 | — | 0.02 | — | — | — | 50 | 120 | 800 | 60 | 3.9 |
| 12 | 3.2 | 0.70 | — | 4.5 | — | — | — | 50 | 120 | 800 | 60 | 4.0 |
| 13 | 3.2 | 0.70 | — | — | — | — | 0.002 | 50 | 120 | 800 | 60 | 3.7 |
| 14 | 3.2 | 0.70 | — | — | — | — | 0.29 | 50 | 120 | 800 | 60 | 3.1 |
| 15 | 3.2 | 0.70 | 1.25 | 0.30 | 0.02 | — | — | 50 | 120 | 800 | 60 | 3.4 |
| 16 | 3.2 | 0.70 | 0.2 | 1.00 | 0.06 | 0.080 | 0.005 | 50 | 120 | 800 | 60 | 3.6 |
| 17 | 1.6 | 0.35 | 0.5 | 0.40 | — | — | — | 50 | 120 | 660 | 60 | 3.4 |

| | Standard | Number of precipitates | Mechanical properties | | |
|---|---|---|---|---|---|
| No. | deviation 2σ (μm) | on grain boundary ($\times 10^3$ per millimeter) | Yield stress (MPa) | Electric Conductivity (% IACS) | W-bending R = 0.05 |
| 1 | 4.4 | 3.5 | 560 | 44 | LD Accepted<br>TD Accepted |
| 2 | 4.1 | 5.0 | 750 | 40 | LD Accepted<br>TD Accepted |
| 3 | 5.3 | 1.5 | 760 | 39 | LD Accepted<br>TD Accepted |
| 4 | 7.5 | 0.7 | 770 | 38 | LD Accepted<br>TD Accepted |
| 5 | 3.9 | 5.0 | 800 | 38 | LD Accepted<br>TD Accepted |
| 6 | 4.0 | 6.5 | 850 | 35 | LD Accepted<br>TD Accepted |
| 7 | 3.8 | 5.0 | 730 | 47 | LD Accepted<br>TD Accepted |
| 8 | 4.4 | 5.0 | 720 | 50 | LD Accepted<br>TD Accepted |
| 9 | 4.6 | 5.0 | 730 | 48 | LD Accepted<br>TD Accepted |
| 10 | 4.4 | 5.0 | 725 | 49 | LD Accepted<br>TD Accepted |
| 11 | 4.2 | 5.0 | 720 | 49 | LD Accepted<br>TD Accepted |
| 12 | 4.8 | 5.0 | 750 | 35 | LD Accepted<br>TD Accepted |
| 13 | 4.3 | 5.0 | 720 | 50 | LD Accepted<br>TD Accepted |
| 14 | 3.8 | 5.5 | 740 | 47 | LD Accepted<br>TD Accepted |
| 15 | 4.6 | 5.5 | 780 | 30 | LD Accepted<br>TD Accepted |
| 16 | 4.7 | 4.0 | 760 | 38 | LD Accepted<br>TD Accepted |
| 17 | 4.3 | 2.5 | 560 | 47 | LD Accepted<br>TD Accepted |

TABLE 2

| No. | Chemical composition Ni | Si | Sn | Zn | Mn | Mg | Cr | Cooling rate (° C./min) | Holding duration (min) | Recrystallization treatment Temperature (° C.) | Duration (sec) | Average size d of crystal grains (μm) |
|---|---|---|---|---|---|---|---|---|---|---|---|---|
| 18 | 1.8 | 0.45 | 0.5 | 0.80 | — | 0.18 | — | 50 | 120 | 720 | 60 | 3.2 |
| 19 | 2.8 | 0.60 | 0.5 | 0.50 | — | — | — | 50 | 120 | 780 | 60 | 3.8 |
| 20 | 2.3 | 0.50 | 0.2 | 0.55 | — | 0.100 | — | 50 | 120 | 750 | 60 | 3.5 |
| 21 | 3.8 | 0.80 | — | — | 0.30 | 0.100 | — | 50 | 120 | 860 | 60 | 3.1 |
| 22 | 2.7 | 0.60 | 0.3 | 1.25 | — | — | — | 50 | 120 | 780 | 60 | 3.7 |
| 23 | 2.7 | 0.60 | — | 0.80 | — | — | — | 50 | 120 | 780 | 60 | 3.5 |
| 24 | 2.0 | 0.40 | — | — | — | 0.100 | — | 50 | 120 | 730 | 60 | 3.4 |
| 25 | 4.7* | 1.20* | 0.1 | 1.00 | 0.04 | — | — | 50 | 120 | | | |
| 26 | 1.3* | 0.25* | 0.1 | 1.00 | 0.04 | — | — | 50 | 120 | 650 | 60 | 4.2 |
| 27 | 3.2 | 0.70 | 1.5* | 1.00 | 0.04 | — | — | 50 | 120 | | | |
| 28 | 3.2 | 0.70 | 1.2 | 6.00* | 0.04 | — | — | 50 | 120 | 800 | 60 | 3.5 |
| 29 | 3.2 | 0.70 | 0.1 | 1.00 | — | 0.300* | — | 50 | 120 | 800 | 60 | 3.4 |
| 30 | 3.2 | 0.70 | 0.2 | 1.00 | 0.02 | — | — | 50 | 120 | 900 | 60 | 12.0* |
| 31 | 3.2 | 0.70 | 0.2 | 1.00 | 0.02 | — | — | 50 | — | 800 | 60 | 6.0 |
| 32 | 3.2 | 0.70 | 0.2 | 1.00 | 0.02 | — | — | 50 | — | 900 | 60 | 13.0* |
| 33 | 3.2 | 0.70 | 0.2 | 1.00 | 0.02 | — | — | 50 | — | 950 | 60 | 30.0* |

| No. | Standard deviation 2σ (μm) | Number of precipitates on gram boundary ($\times 10^3$ per millimeter) | Mechanical properties Yield stress (MPa) | Electric Conductivity (% IACS) | W-bending R = 0.05 | |
|---|---|---|---|---|---|---|
| 18 | 3.5 | 3.5 | 580 | 40 | LD | Accepted |
| | | | | | TD | Accepted |
| 19 | 4.1 | 4.5 | 700 | 38 | LD | Accepted |
| | | | | | TD | Accepted |
| 20 | 3.8 | 4.0 | 630 | 40 | LD | Accepted |
| | | | | | TD | Accepted |
| 21 | 3.9 | 5.5 | 810 | 37 | LD | Accepted |
| | | | | | TD | Accepted |
| 22 | 4.8 | 4.5 | 700 | 37 | LD | Accepted |
| | | | | | TD | Accepted |
| 23 | 4.5 | 4.5 | 680 | 40 | LD | Accepted |
| | | | | | TD | Accepted |
| 24 | 3.7 | 3.5 | 600 | 42 | LD | Accepted |
| | | | | | TD | Accepted |
| 25 | | | | | LD | |
| | | | | | TD | |
| 26 | 6.5 | 1.5 | 470 | 52 | LD | Accepted |
| | | | | | TD | Accepted |
| 27 | | | | | LD | |
| | | | | | TD | |
| 28 | 4.7 | 5.0 | 790 | 32 | LD | Failed |
| | | | | | TD | Failed |
| 29 | 3.9 | 5.0 | 770 | 33 | LD | Failed |
| | | | | | TD | Failed |
| 30 | 7.4 | 0.3* | 775 | 37 | LD | Failed |
| | | | | | TD | Failed |
| 31 | 11.0* | 2.0 | 750 | 40 | LD | Failed |
| | | | | | TD | Failed |
| 32 | 7.4 | 0.3* | 775 | 33 | LD | Failed |
| | | | | | TD | Failed |
| 33 | 18.0* | 0* | 780 | 32 | LD | Failed |
| | | | | | TD | Failed |

Next, each of the sheets was subjected to facing each 1 mm on both sides thereof, subjected to cold rolling to a thickness of 0.25 mm (reduction ratio of 98.6%), subjected to a recrystallization treatment with partial solution treatment under conditions in Tables 1 and 2, and subsequently quenched in water. However, Samples Nos. 25 and 27 suffered from cracking during hot rolling, and were not subjected to the cold rolling and subsequent steps. In this connection, Sample No. 25 has excessively high Ni and Si contents, and Sample No. 27 has an excessively high Sn content.

Next, the other samples were subjected to cold rolling to a thickness of 0.2 mm (reduction ratio of 20%) and then subjected to precipitation treatment at 500° C. for 2 hours.

For Samples Nos. 1-24, 26, and 28-33, test pieces were cut from the resulting copper alloy sheets and subjected to measurements of strength (0.2% yield stress) in tensile tests; measurements of electric conductivity; W-bending tests; measurements of crystal grain size; and measurements of dispersed precipitates on grain boundaries, according to the following procedures. The results are shown in Tables 1 and 2.

Tensile Test

Tensile tests were conducted in accordance with the method specified in Japanese Industrial Standards (JIS) Z-2241 using JIS No. 5 test pieces with the rolling direction as a longitudinal direction, to determine a 0.2%, yield stress. A sample having a yield stress of 500 MPa or more was accepted.

Measurement of Electric Conductivity

Electric resistances of test pieces 10 mm wide and 300 mm long with the rolling direction as a longitudinal direction were measured with a double-bridge electrical resistance meter in accordance with the measuring methods for electrical conductivity of non-ferrous materials specified in JIS H-0505, from which electric conductivities were calculated according to the average cross section method.

W-Bending Test

W-bending tests at a radium R of 0.05 mm were conducted in accordance with the W-bending test specified by Japan Copper and Brass Association (JCBA) standards T307 on test pieces 10 mm wide and 30 mm long, each having a direction in parallel to the rolling direction (longitudinal to rolling direction, hereinafter abbreviated as "L.D.") and a direction transverse to the rolling direction (transverse to rolling direction, hereinafter abbreviated as "T.D.") as its longitudinal direction. The appearances of outside bent portions of the test pieces after the W-bending tests were observed with an optical microscope at a magnification of 50 times, and whether or not cracks were generated was determined. A sample without cracking was evaluated as "Accepted", and a sample with cracking was evaluated as "Failed".

Measurement of Crystal Grain Size

The crystal grain sizes were measured with a field-emission electron microscope equipped with a back scattered electron diffraction pattern (data collection) system supplied by TSL according to the crystal orientation analytic method. Electron beams were applied at a step of 0.4 μm to a 125-μm square region to be measured, and a portion with a difference in crystal orientation of 15 degrees or more was regarded as a grain boundary. The areas of respective crystal grains in the region were measured, and crystal grain sizes (diameters corresponding to circle) were determined. The average size of crystal grains is represented by $\Sigma(dn \cdot Fn)$, in which "n" represents the number of measured crystal grains; "an" represents the area of each crystal grain; "dn" represents the size of each crystal grain; "A" represents the total area; and Fn (=an/A) represents the occupancy of each crystal grain. The standard deviation σ of crystal grain size was determined from the crystal grain size dn and the occupancy Fn of crystal grain to the total area.

Measurement of Dispersed Precipitates Lying on Grain Boundary

Thin-film samples were prepared through electropolishing, from which bright-field images were obtained with a field-emission electron microscope at a magnification of 50000 times, and the number of precipitates lying on grain boundaries and having a diameter of from 30 to 300 nm was counted.

With reference to Tables 1 and 2, Samples Nos. 1 to 24 have compositions specified in the present invention and satisfy the requirements in the present invention, in which the average size of crystal grains is 10 μm or less, and the standard deviation σ of crystal grain size satisfies the condition: $2\sigma<10$ μm. They also have a number (abundance) of precipitates of 500 or more per millimeter, which lie on grain boundaries and have a diameter of from 30 to 300 nm. Among them, Samples Nos. 1, 2, and 5 to 24 contain a large number of dispersed precipitates, have a small average size of crystal grains of 5 μm or less, and have a grain size d satisfying the condition: $d \leq 2\sigma$. With respect to the properties, Samples Nos. 1 to 24 excel both in strength and W-bending workability (both in L.D. and T.D.).

In contrast, Samples Nos. 26, 28, and 29 satisfy the requirements in the present invention regarding the average size of crystal grains, the standard deviation of crystal grain size, and the number (abundance) of dispersed precipitates lying on grain boundaries and having a diameter of from 30 to 300 nm. However, Sample No. 26 is inferior in strength because of low Ni and Si contents; and Samples Nos. 28 and 29 are inferior in bending workability because of excessively high Zn content and excessively high Mg content, respectively.

Sample No. 30 has an excessively high average size of crystal grains and a small number of dispersed precipitates lying on grain boundaries and is inferior in bending workability. This is probably because the recrystallization treatment was conducted at a high temperature in relation to the Ni and Si contents, precipitates once produced are thereby dissolved to form a solid solution, and this reduces the number (amount) of dispersed precipitates lying on grain boundaries, resulting in the generation of coarse crystal grains in the recrystallization treatment.

Sample No. 31 has a standard deviation of crystal grain size exceeding the above-specified range and has inferior bending workability. Though satisfying the required conditions of dispersed precipitates in the final product, this sample shows an excessively large standard deviation of crystal grain size as a result of the recrystallization treatment. This is probably because of the absence of precipitation treatment after hot rolling.

Sample No. 32 has an average size of crystal grains exceeding the above-specified range and a small number of dispersed precipitates lying on grain boundaries and has inferior bending workability. This is probably because dissolution (conversion to solution) proceeds and sufficient dispersed precipitates do not exist due to the absence of precipitation treatment after hot rolling and to the high recrystallization treatment temperature in relation to the Ni and Si contents, and this causes crystal grains to become coarse in the recrystallization treatment.

Sample No. 33 has an average size of crystal grains and a standard deviation of crystal grain size both exceeding the above-specified ranges and a small number of dispersed precipitates lying on grain boundaries and has inferior bending workability. This is probably because dissolution (conversion to solution) proceeds and the number of precipitates having pining effects and lying on grain boundaries is reduced due to the absence of precipitation treatment after hot rolling and to the high recrystallization treatment temperature in relation to the Ni and Si contents, and this causes crystal grains to become coarse and to have a larger standard deviation of grain size during the recrystallization treatment.

The invention claimed is:

1. A copper alloy sheet excellent in strength and formability for use in electrical and electronic components, the copper alloy sheet comprising, by mass, 1.5% to 4.5% of nickel (Ni) and 0.3% to 1.0% of silicon (Si), with the remainder being copper and inevitable impurities, wherein the copper alloy sheet has an average size of crystal grains of 10 μm or less, a standard deviation σ of crystal grain size satisfying the condition: $2\sigma<10$ μm, and a number of dispersed precipitates of 500 or more per millimeter, the dispersed precipitates lying on grain boundaries and having a diameter of from 30 to 300 nm.

2. The copper alloy sheet excellent in strength and formability for use in electrical and electronic components, according to claim 1, further comprising either one or both of 0.01% to 1.3% of tin (Sn) and 0.005% to 0.2% of magnesium (Mg).

3. The copper alloy sheet excellent in strength and formability for use in electrical and electronic components, according to claim 1, further comprising 0.01% to 5% of zinc (Zn).

4. The copper alloy sheet excellent in strength and formability for use in electrical and electronic components, according to claim 1, further comprising either one or both of 0.01% to 0.5% of manganese (Mn) and 0.001% to 0.3% of chromium (Cr).

5. The copper alloy sheet excellent in strength and formability for use in electrical and electronic components, according to claim 1, further comprising a total of 0.1% or less of at least one member selected from the first group of elements consisting of B, C, P, S, Ca, V, Ga, Ge, Nb, Mo, Hf, Ta, Bi, and Pb, each in a content of 0.0001% to 0.1%; and a total of 1% or less of at least one member selected from the second group of elements consisting of Be, Al, Ti, Fe, Co, Zr, Ag, Cd, In, Sb, Te, and Au, each in a content of 0.001% to 1%, the total content of the first and second groups of elements being 1% or less.

6. The copper alloy sheet excellent in strength and formability for use in electrical and electronic components, according to claim 1, further comprising a total of 0.1% or less of at least one member selected from the first group of elements consisting of B, C, P, S, Ca, V, Ga, Ge, Nb, Mo, Hf, Ta, Bi, and Pb, each in a content of 0.0001% to 0.1%.

7. The copper alloy sheet excellent in strength and formability for use in electrical and electronic components, according to claim 1, further comprising a total of 1% or less of at least one member selected from the second group of elements consisting of Be, Al, Ti, Fe, Co, Zr, Ag, Cd, In, Sb, Te, and Au, each in a content of 0.001% to 1%, the total content of the first and second groups of elements being 1% or less.

8. The copper alloy sheet excellent in strength and formability for use in electrical and electronic components, according to claim 5, comprising the Ti and Zr.

9. The copper alloy sheet excellent in strength and formability for use in electrical and electronic components, according to claim 1, which comprises 1.7% to 3.9% of nickel (Ni).

10. The copper alloy sheet excellent in strength and formability for use in electrical and electronic components, according to claim 1, which comprises 0.35% to 0.90% of silicon (Si).

11. The copper alloy sheet excellent in strength and formability for use in electrical and electronic components, according to claim 1, wherein the ratio of the nickel (Ni) content to the silicon (Si) content is 4.0 to 5.0.

12. The copper alloy sheet excellent in strength and formability for use in electrical and electronic components, according to claim 1, wherein the ratio of the nickel content to the silicon content is around 4.5.

13. The copper alloy sheet excellent in strength and formability for use in electrical and electronic components, according to claim 1, wherein the average size d of crystal grains and the standard deviation $\sigma$ satisfy the relationship $d \leq 2\sigma$.

14. The copper alloy sheet excellent in strength and formability for use in electrical and electronic components, according to claim 1, further comprising 0.01% to 0.6% of tin (Sn).

15. The copper alloy sheet excellent in strength and formability for use in electrical and electronic components, according to claim 1, further comprising 0.005% to 0.05% of magnesium (Mg).

16. The copper alloy sheet excellent in strength and formability for use in electrical and electronic components, according to claim 1, further comprising 0.01% to 1.2% of zinc (Zn).

17. The copper alloy sheet excellent in strength and formability for use in electrical and electronic components, according to claim 1, further comprising 0.01% to 0.3% of tin (Sn).

18. The copper alloy sheet excellent in strength and formability for use in electrical and electronic components, according to claim 1, further comprising 0.01 to 0.3% of manganese (Mn).

19. The copper alloy sheet excellent in strength and formability for use in electrical and electronic components, according to claim 1, further comprising 0.001% to 0.1% of chromium (Cr).

20. The copper alloy sheet excellent in strength and formability for use in electrical and electronic components, according to claim 1, wherein the copper sheet is fabricated by a sequential process comprising melting/casting, soaking, hot rolling, precipitation treatment after hot rolling, cold rolling, recrystallization treatment with partial solution treatment and low-temperature annealing.

* * * * *